United States Patent [19]

Dewhurst et al.

[11] 4,403,383

[45] Sep. 13, 1983

[54] ELECTRICAL LEAD TRANSFER UNIT

[75] Inventors: Paul E. Dewhurst; John C. Collier, both of Southport, England

[73] Assignee: BICC PLC and Burndy Corporation, Norwalk, Conn.

[21] Appl. No.: 287,529

[22] Filed: Jul. 27, 1981

Related U.S. Application Data

[63] Continuation of Ser. No. 54,971, Jul. 5, 1979, abandoned.

[30] Foreign Application Priority Data

Jul. 4, 1978 [GB] United Kingdom ..... 28714/78
Dec. 1, 1978 [GB] United Kingdom ..... 46880/78

[51] Int. Cl.[3] ..... H01R 43/04
[52] U.S. Cl. ..... 29/33 M; 29/564.4
[58] Field of Search ..... 29/33 M, 564.4, 566.1, 29/748, 753; 81/9.51

[56] References Cited

U.S. PATENT DOCUMENTS 2,680,394 6/1954 Andren ..... 81/9.51
3,570,100 3/1971 Kindell et al. ..... 29/564.4
3,653,412 4/1972 Gudmestad ..... 81/9.51 X
3,659,328 5/1972 Klein ..... 29/564.4
3,769,681 11/1973 Eubanks ..... 29/564.4

*Primary Examiner*—William R. Briggs
*Attorney, Agent, or Firm*—Buell, Blenko, Ziesenheim & Beck

[57] ABSTRACT

A unit for transferring an electrical lead from a measuring, cutting and stripping machine 21 to a terminating machine 31 includes an electrical lead gripping device 6 which is carried by a fluid-operated piston 3 working in a cylinder 2 and which can be caused to reciprocate between a position at which the gripping device grips an electrical lead in the measuring, cutting and stripping machine and a position at which an electrical termination can be secured by the terminating machine to a stripped end of an electrical lead carried by the gripping device. The unit also includes a device 7 for ejecting a terminated electrical lead from the gripping device 6. A control system, preferably fluid-operated, effects automatic reciprocation of the gripping device 6 between said two positions and operation of the ejection device 7 in synchronization with the cycles of operations of the measuring, cutting and stripping machine 21 and of the terminating machine 31.

10 Claims, 6 Drawing Figures

Fig.4.
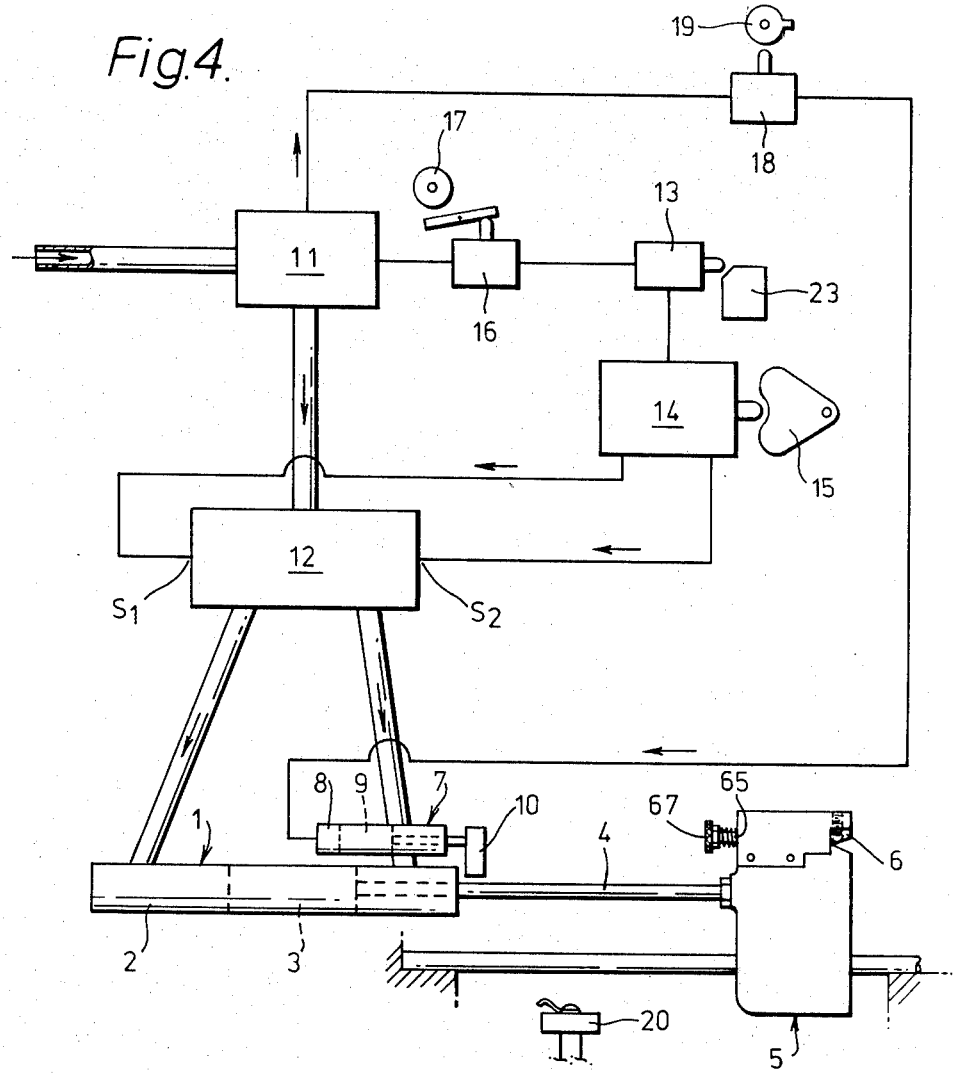
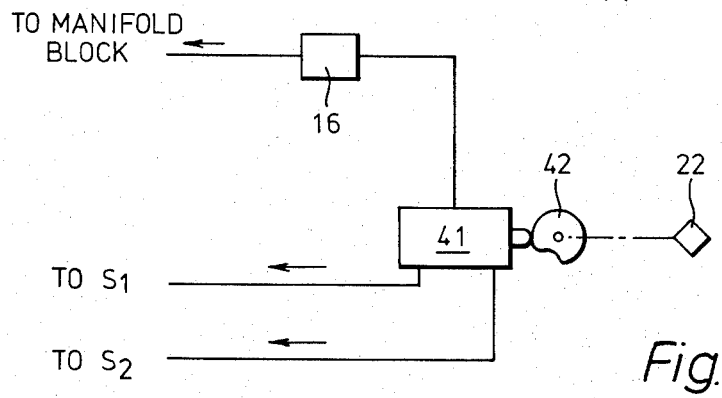
Fig.5.

ELECTRICAL LEAD TRANSFER UNIT

This is a continuation of application Ser. No. 54,971, filed July 5, 1979 now abandoned.

Electrical leads for use with many kinds of electrical apparatus each comprise a predetermined length of flexible insulated conductor to at least one end of which an electrical termination is secured. In the manufacture of such electrical leads a flexible electrically insulated conductor is fed to a first machine (hereinafter referred to as a measuring, cutting and stripping machine) which measures a predetermined length of the insulated conductor, cuts the insulated conductor to said predetermined length and strips the insulation from said predetermined length of insulated conductor at one or each of its ends. A second machine (hereinafter referred to as a terminating machine) is employed to secure an electrical termination to a stripped end of each of said predetermined lengths of insulated conductor to form an electrical lead.

To facilitate a high rate of production of such electrical leads, it is the general practice to mount these two machines alongside one another with their cycles of operations synchronised and to employ apparatus which automatically transfers each cut and stripped predetermined length of insulated conductor in turn from the measuring, cutting and stripping machine to the terminating machine, such automatic transfer apparatus hereinafter, for convenience, being referred to as "an electrical lead transfer unit." Electrical lead transfer units that have hitherto been in general use are complicated and expensive and it is an object of the present invention to provide an improved electrical lead transfer unit which is simple in design and inexpensive to manufacture.

According to the invention we provide for use with a measuring, cutting and stripping machine and a terminating machine whose cycles of operations are synchronised, an electrical lead transfer unit comprising an electrical lead gripping device which is carried by a fluid operated piston working in a cylinder and which can be caused to reciprocate between a position at which the gripping device grips an electrical lead being measured, cut and stripped in the measuring, cutting and stripping machine and a position at which an electrical termination can be secured by the terminating machine to a stripped end of an electrical lead carried by the gripping device; means for ejecting an electrical lead from the gripping device after an electrical termination has been secured to one of the ends of the electrical lead, which automatic ejection means comprises a spring loaded, pneumatically operated piston working in a cylinder which is connected to an air pressure supply via a normally closed valve controlled by a cam rotatably driven by the drive shaft of the terminating machine, the cam being so shaped that, after a termination has been secured to an electrical lead, it opens the valve to effect the operation of the piston against the action of its spring to push the terminated electrical lead out of the gripping device; and a control system for effecting automatic reciprocation of the gripping device between said two positions and operation of the ejection means in synchronisation with the cycles of operations of the measuring, cutting and stripping machine and of the terminating machine.

Preferably, the control system is a fluid-operated system coupled directly to the cylinder of the fluid-operated piston carrying the gripping device and, in order to effect automatic reciprocation of the gripping device and operation of the ejection means in synchronisation with the cycles of operations of the measuring, cutting and stripping machine and of the terminating machine, the fluid-operated control system includes means for detecting the cycle of operations of each of these machines. In a preferred embodiment, the control system and the piston carrying the gripping device are pneumatically operated.

In one preferred control system, the means for detecting the cycle of operations of the measuring, cutting and stripping machine controls the operation of a known form of electrically actuated spring biased changeover valve which has a single main inlet to which air pressure is continuously applied and a pair of outlets connected to the cylinder housing the piston carrying the gripping device on opposite sides of the piston, the attitude of the changeover valve being changed from its spring biased position to the other of its two positions by the application of an electrical signal to a solenoid operating the valve.

Since an uninterrupted air supply is connected to the main inlet of the changeover valve, in the spring biased position of the valve the gripping device carried by the piston can be maintained either in the position at which an electrical termination can be secured by the terminating machine to a stripped end of an electrical lead carried by the gripping device or in the position at which the gripping device grips an electrical lead being measured, cut and stripped by the measuring, cutting and stripping machine.

In this case, preferably the means for detecting the cycle of operations of the measuring, cutting and stripping machine is an electric control circuit in which are connected in series the solenoid of the electrically operated spring biased changeover valve and a plurality of electrical switches actuated in sequence by the measuring, cutting and stripping machine during its cycle of operations.

In a second preferred control system, the means for detecting the cycle of operations of the measuring, cutting and stripping machine controls the operation of a known form of changeover valve which has a single main inlet to which air pressure is continuously applied and a pair of outlets connected to the cylinder on opposite sides of the piston carrying the gripping device, the attitude of the changeover valve being determined by signal air pressure being applied to one of two opposed signal inlet ports under the control of said detecting means. Since an uninterrupted air supply is connected to the main inlet of the changeover valve, the gripping device carried by the piston will be maintained either in the position at which the gripping device grips an electrical lead being measured, cut and stripped by the measuring, cutting and stripping machine or in the position at which an electrical termination can be secured by the terminating machine to a stripped end of an electrical lead carried by the gripping device, in accordance with the last signal air pressure that was fed into the changeover valve.

In this second case, preferably the means for detecting the cycles of operations of the measuring, cutting and stripping machine is a signal air system comprising a normally closed valve to which signal air pressure is continuously applied and which is connected to the single inlet of a spring-biased changeover valve which has a pair of outlets connected to the signal inlet ports of the pilot changeover valve, the attitude of the spring-biased changeover valve being so biased that the connection is normally open between the spring-biased changeover valve and that signal inlet port of the pilot changeover valve to which signal air pressure must be applied to cause the attitude of the pilot changeover valve to be such that main air pressure will be fed to the rear end of the cylinder to cause the gripping device to move to the position at which it will grip an electrical lead in the measuring, cutting and stripping machine. The arrangement is such that, when a predetermined length of electrically insulated conductor has been measured by the measuring, cutting and stripping machine, the normally closed valve is automatically opened and signal air pressure flows through the spring-biased changeover valve to the said signal inlet port of the pilot changeover valve to cause the attitude of the pilot changeover valve to be such that main air pressure is fed to the rear end of the cylinder to cause the gripping device to move to the measuring, cutting and stripping machine and grip the predetermined length of insulated conductor. When the predetermined length of insulated conductor has been cut to form an electrical lead and insulation has been stripped from its end, the attitude of the spring-biased changeover valve is automatically changed against the action of the spring so that signal air pressure is fed to the other one of the signal inlet ports of the pilot changeover valve to change the attitude of this valve and so cause the main air pressure to be fed to the front of the cylinder so that the piston carrying the gripping device is caused to move in the opposite direction to bring the gripping device carrying the electrical lead to the position at which an electrical termination can be secured to its stripped end by the terminating machine. As the cycle of operations of the measuring, cutting and stripping machine is concluded, the normally closed valve closes and the attitude of the spring-biased changeover valve returns to its biased position.

An alternative means for detecting the cycle of operations of the measuring, cutting and stripping machine is a signal air system comprising a single spring-biased changeover valve having a single inlet connected to a continuous signal air pressure and a pair of outlets connected to the signal inlet ports of the pilot changeover valve, the changeover valve being biased as previously described. Actuation of the spring-biased changeover valve is controlled by a rotating cam so coupled to the drive shaft of the measuring, cutting and stripping machine that appropriate changeover of the valve to ensure reciprocation of the gripping device back and forth between said two positions is effected once per cycle of operations of the measuring, cutting and stripping machine.

Operation of the terminating machine in synchronisation with the cycle of operations of the measuring, cutting and stripping machine and transfer of an electrical lead from the measuring, cutting and stripping machine to the position at which an electrical termination can be secured to a stripped end of the electrical lead preferably is effected by means of a micro-switch which is actuated by the gripping device to start the cycle of operations of the terminating machine as the gripping device reaches the position at which an electrical termination can be secured to an electrical lead.

Preferably, the gripping device comprises a head which is mounted on one end of a substantially rigid elongate member connected to or integral with the piston and which carries a pivoted, spring-loaded finger, the arrangement being such that an electrical lead can be gripped between the spring-loaded finger and a surface of the head.

The invention also includes automatic electrical lead processing apparatus comprising a measuring, cutting and stripping machine, a terminating machine and, associated with said two machines, an electrical lead transfer unit as hereinbefore described, the cycles of operations of the two machines and of the transfer unit being synchronised for automatic processing of electrical leads.

The invention will be further illustrated by a description, by way of example, of two preferred forms of pneumatically operated, electrical lead transfer unit with reference to the accompanying diagrammatic drawings, in which:

FIG. 4 shows the pneumatic control system of the electrical lead transfer unit shown in FIG. 3;

FIG. 5 is a fragmental view of a modified pneumatic control system for the electrical lead transfer unit shown in FIG. 3.

Figure 1:
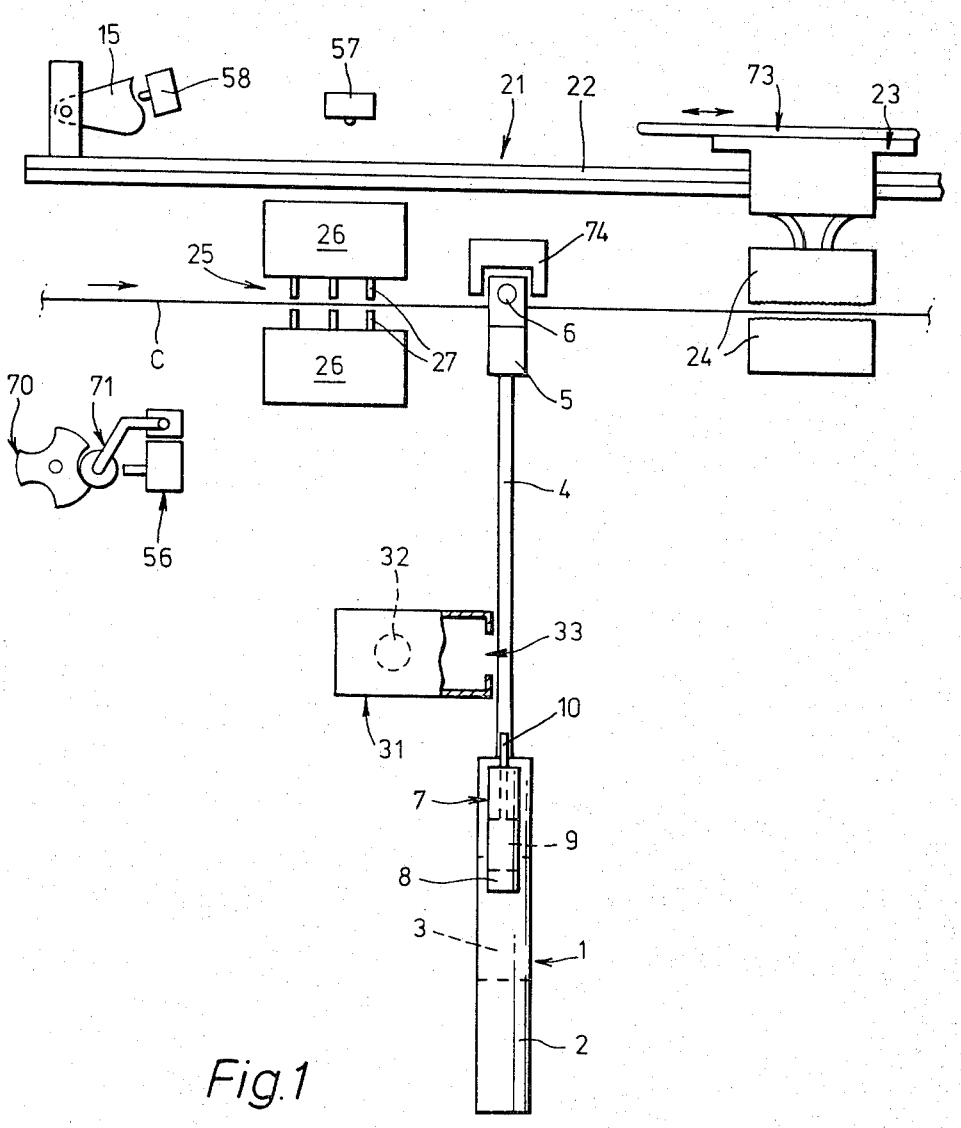
FIG. 1 is a schematic layout of automatic electrical lead processing apparatus incorporating the first preferred electrical lead transfer unit.

Referring to FIG. 1, the electrical lead processing apparatus comprises a measuring, cutting and stripping machine 21, a terminating machine 31 and, for transferring electrical leads in succession from the measuring, cutting and stripping machine to the terminating machine, the first preferred electrical lead transfer unit 1.

The measuring, cutting and stripping machine 21 includes a shaft 22 of substantially square cross section along which a block 23 carrying clamping jaws 24 can be caused to reciprocate and, at a cutting and stripping station 25, two opposed heads 26 on which are carried three diametrically opposed pairs of cutters 27. In each cycle of operation of this known machine, with the block 23 in position adjacent to the cutting and stripping station 25, the jaws 24 of the block 23 clamp onto the leading end of electrically insulated conductor C being fed to the machine and the block moves along the shaft 22 to pull the insulated conductor through the machine until a predetermined length of insulated conductor extends between the block and the cutting and stripping station 25. The three cutters 27 then cut the insulated conductor at each of three longitudinally spaced positions. The central pair of cutters sever the insulated conductor to form an electrical lead whose leading end is held in the clamping jaws 24; each of the other pairs of cutters cuts through the electrical insulation but not through the conductor itself, the short length of severed insulation on each side of the central cut being subsequently stripped from the conductor by appropriate movement of the block 23. The clamping jaws 24 then release the electrical lead and move back to grip the leading end of the insulated conductor C at the cutting and stripping station 25. Operation of the reciprocating block 23 and clamping jaws 24 and the cutting and stripping mechanism is controlled by the motor driven shaft 22 in a manner not material to the present invention. If the predetermined length of insulated conductor required cannot be obtained by a single stroke of the block 23, the block and jaws 24 can be caused to reciprocate several times under the control of a multi-stroke control cam 70 and associated cam roller 71, the cutter blades 27, whose operation has been overridden during reciprocation of the block, being brought into operation when the required length of insulated conductor has been obtained.

The terminating machine 31 has a main shaft 32 on which is carried a pair of crimping blades (not shown) which, on the down stroke, crimp an electrical termination being fed to the machine on to a stripped end of an electrical lead positioned at the terminating position 33, the crimped termination being released from the crimping blades on the first part of the upstroke.

The electrical lead transfer unit 1 comprises a cylinder 2 housing a pneumatically operated piston 3 connected to which is a rod 4 having at its free end a head 5 to the upper surface of which a spring-loaded finger 6 (FIG. 6) constituting the electrical lead gripping device is secured. Mounted above the cylinder 1, adjacent the terminating position 33 of the terminating machine 31, is an ejection device 7 comprising a cylinder 8 having a spring-loaded, pneumatically operated piston 9 which carries a pusher 10 at its free end, the piston being biased in the withdrawn position. The control system of the first preferred transfer unit 1 is shown in FIG. 1.

Figure 2:
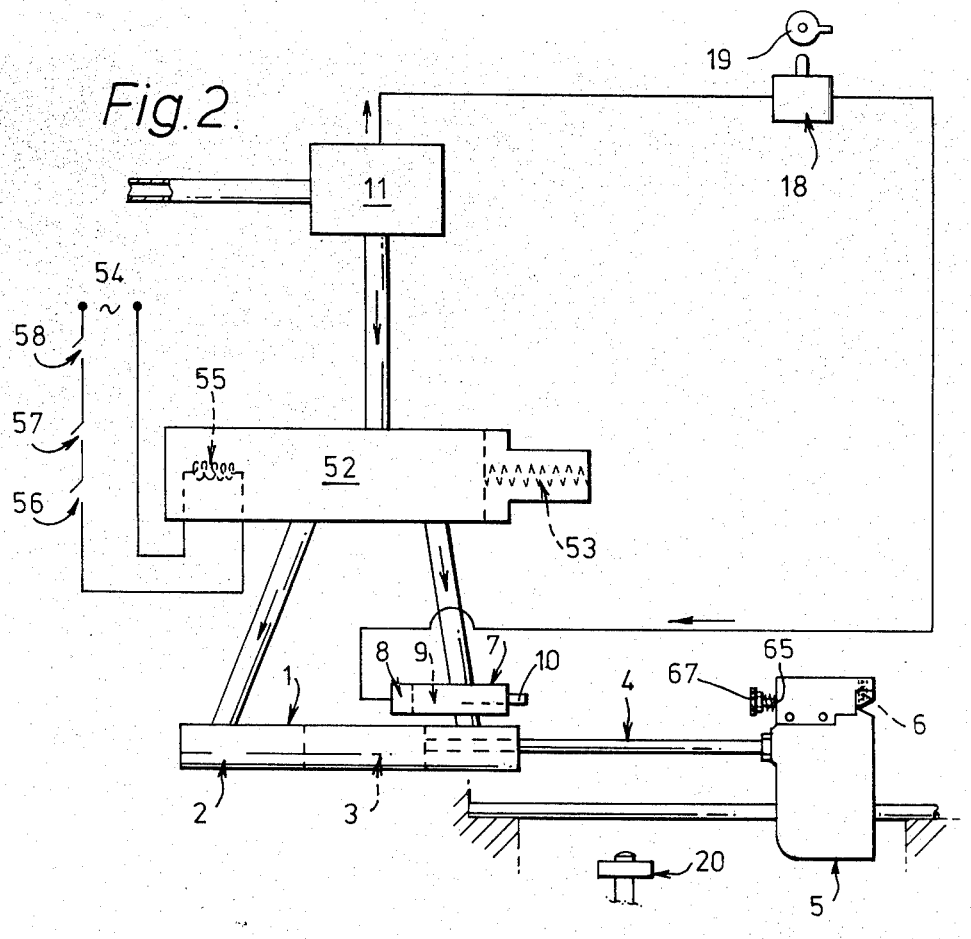
FIG. 2 shows the control system of the electrical lead transfer unit shown in FIG. 1.

Referring to FIG. 2, a main air pressure supply for operation of the reciprocating piston 3 carrying the gripping device 6 is continuously fed to the cylinder 2 via a manifold block 11 and an electrically operated spring-biased changeover valve 52 which has one main inlet and two main outlets, one feeding into the rear end of the cylinder 2 behind the piston 3 and the other feeding into the forward end of the cylinder in front of the piston. The changeover valve 52 is so biased by its biasing spring 53 that it is normally held in the position in which air pressure is fed into the forward end of the cylinder 2 in front of the piston 3 to retain the gripping device 6 in the retracted position. Change of the changeover valve 52 to the other of its two positions is electrically controlled by a solenoid 55 which is connected in an electrical control circuit 54 and which, when energised, overrides the spring 53 to change the attitude of the changeover valve and so cause air pressure to be fed to the rear end of the cylinder 2. Connected in series with solenoid 55 in the electrical control circuit 54 are three micro-switches 56, 57 and 58.

As will be seen in FIG. 1, micro-switch 56 is mounted adjacent the roller 71 associated with the multi-stroke control cam 70 and, when the control cam is not engaged, the roller 71 allows the micro-switch 56 to adopt the closed position. Micro-switch 57 is mounted adjacent the shaft 22 at the cutting and stripping station 25 and is held open by a slide 73 on the block 23 when the block is in position in the cutting and stripping station. Micro-switch 58 is actuated by a cam 15 operatively connected to the square shaft 22 in a manner to be described and, when the block 23 is in position in the cutting and stripping station 25 at the start of a cycle of operations of the measuring, cutting and stripping machine, the micro-switch 58 is in the closed position.

Operation of the ejection device 7 is controlled by signal air pressure fed from the manifold block 11 through a normally closed valve 18 to the rear end of the cylinder 8 of the ejection device. Opening of the normally closed valve 18 to cause the piston 9 of the ejection device 7 to be urged forward is controlled by a cam 19 mounted on the main shaft 32 of the terminating machine 31.

The cycle of operations of the terminating machine is controlled by a micro-switch 20 actuated by the head 5 of reciprocating piston 3 in a manner to be described.

When the electrical lead processing apparatus is in operation, with the block 23 in the cutting and stripping station 25, the clamping jaws 24 on the block grip the leading end of the insulated conductor C and start to draw it through the machine 21. For an electrical lead of a length effected by a single stroke of the block 23, the cam roller 71 permits the micro-switch 56 to adopt its normal closed position. As the block 23 moves away from the cutting and stripping station 25, to a position near the end of its stroke at which the cutting heads 26 start to close and the cutters 27 are brought into operation as previously described, the slide 73 disengages from the open micro-switch 57 to permit it to return to its normally closed position.

All three micro-switches 56,57 and 58 are now closed and the solenoid 55 is energised to override the biasing spring 53 of the changeover valve 52 and to change the attitude of the valve so that air pressure if fed to the rear end of the cylinder 2 to urge the piston 3 towards the machine 21 so that a fixed U-shaped bracket 74 pushes the insulated conductor under the spring-loaded finger 6 which holds the insulated conductor against the upper surface of the head 5.

The head 23 now moves a short distance to the right to enable the insulation to be stripped from one end of the insulated conductor and the shaft 22 rotates to open the jaws 24 and release the insulated conductor, this rotational motion causing the cam 15 to rotate and open micro-switch 58. As a result, the solenoid 55 is de-energised, the attitude of the changeover valve 52 changes under the action of biasing spring 53 and air pressure is fed to the forward end of the cylinder 2 to cause the piston 3 to retract so that the head 5 carrying the spring-loaded finger 6 gripping the electrical lead is withdrawn so that the electrical lead is positioned at the terminating position 33. As the head 5 is retracted and the spring-loaded finger 6 approaches the terminating position 33, the head actuates the micro-switch 20 to bring the terminating machine 31 into operation.

The terminating machine 31 crimps an electrical termination to the stripped end of the electrical lead gripped by the spring-loaded finger 6 and, when the crimped termination has been released from the crimping blades, the cam 19 opens the normally closed valve 18 so that signal air pressure is fed to the cylinder 8 of the ejection device 7 to cause the piston 9 to move forward and the pusher 10 to engage a spring-loaded plunger 65 (FIG. 6) carried by the head 5 to cause the plunger to push the terminated electrical lead from beneath the spring-loaded finger 6. At the completion of the crimping cycle the cam 19 allows the valve 18 to close and the piston 9 returns to its retracted position under the action of its biassing spring.

Meanwhile the head 23 moves back towards the cutting and stripping station 25 and, as it approaches this station, the slide 73 opens micro-switch 57. At the completion of this stroke of the head 23, the shaft 22 rotates to cause the jaws 24 to grip the leading end of the insulated conductor C and to cause the cam 15 to rotate to a sufficient extent to permit micro-switch 58 to close, but because micro-switch 57 is now open, solenoid 55 remains de-energised and no movement of piston 3 occurs. The head 23 now moves a short distance to the left to enable the insulation to be stripped from the leading end of the insulated conductor C—this distance being insufficient for the head to disengage micro-switch 57 and permit it to close—and the heads 26 then move apart to allow the jaws 24 to pass through whilst gripping the insulated conductor.

The micro-switches 56, 57 and 58 are now in the appropriate attitudes for the cycle of operations to be repeated as described.

Where a length of electrical lead required is such that the block 23 must make more than one stroke before the insulated conductor is cut, the multi-stroke control cam 70 is engaged and, before the block moves away from the cutting and stripping station 25, the roller 71 opens the micro-switch 56. During the reciprocating motion of the block 23, the micro-switches 57 and 58 are actuated as previously described but as micro switch 56 is open, solenoid 55 remains de-energised and no movement of piston 3 occurs; the control cam 70 also prevents cutter heads 26 from closing. On the second, or final, reciprocating motion of the block 23, before the block moves away from the cutting and stripping station 25 the control cam 70 rotates so that the roller 70 moves to allow the micro-switch 56 to return to its normally closed position. All the micro-switches 56, 57 and 58 are now in the appropriate attitudes for the cycle of operations to be repeated as described.

Use of a control system in which operation of the wire transfer unit is controlled by micro-switches enables accurately defined signals and sharp response characteristics to be obtained.

Figure 3:
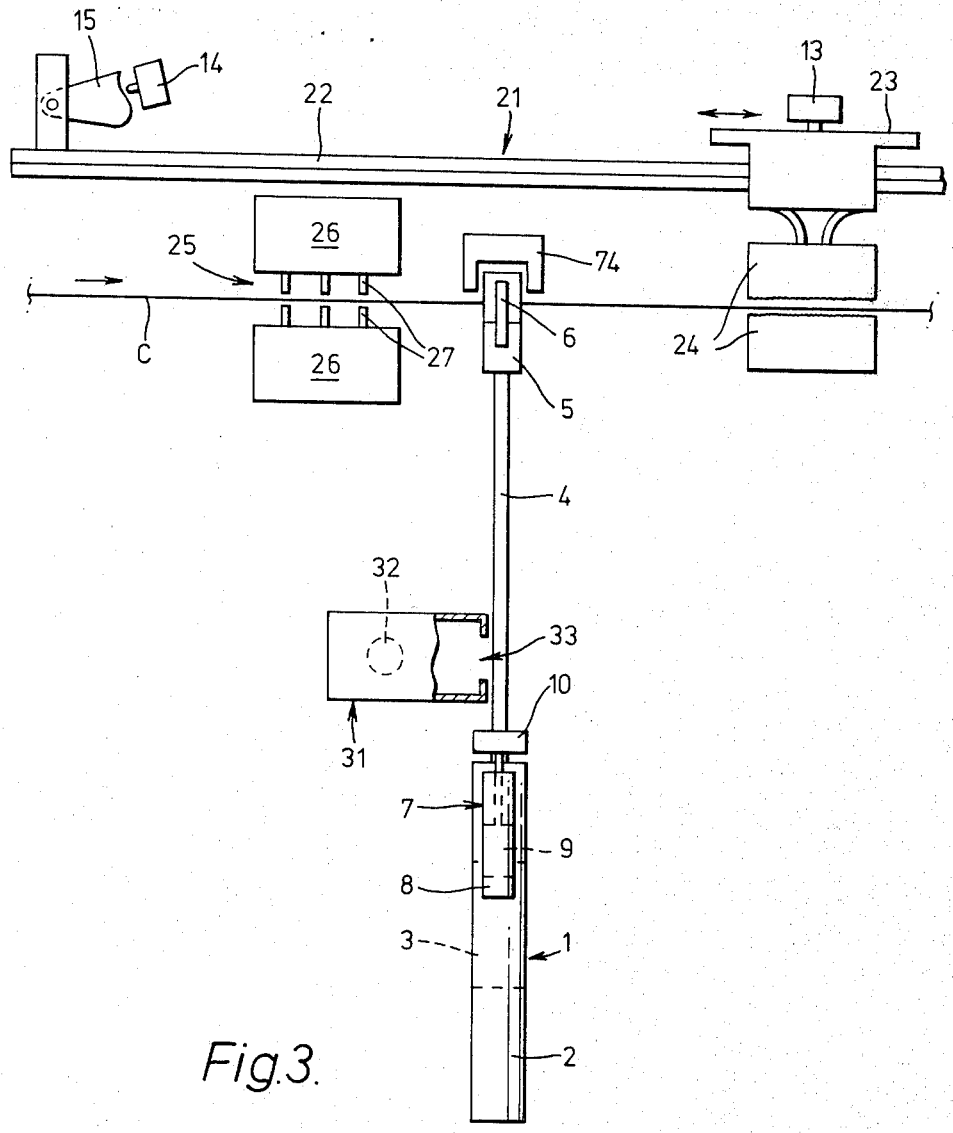
FIG. 3 is a schematic layout of automatic electrical lead processing apparatus incorporating the second preferred electrical lead transfer unit.

In FIG. 3 illustrating the automatic electrical lead processing apparatus incorporating the second preferred electrical lead transfer unit, components that are the same as corresponding components in the apparatus shown in FIG. 1 are given the same reference numerals. Any differences in construction of the second preferred electrical lead transfer unit will be apparent from the description of the pneumatic control system that will now be given with reference to FIGS. 3 and 4.

A main air pressure supply for operation of the reciprocating piston 3 carrying the spring-loaded finger 6 is continuously fed to the cylinder 2 via a manifold block 11 and a pilot changeover valve 12 which has which has one main inlet and two main outlets, one feeding into the rear end of the cylinder 2 behind the piston 3 and the other feeding into the forward end of the cylinder in front of the piston. The attitude of the pilot changeover valve 12 is controlled by signal air pressure fed from the manifold block 11 through a normally closed valve 13 and a spring-biased changeover valve 14 which has a single inlet and a pair of outlets feeding signal inlet ports $S_1$ and $S_2$ in the pilot changeover valve 12. The changeover valve 4 is so biased that the connection to the signal inlet port $S_1$ is normally open so that, when signal air pressure is applied to the changeover valve 14, signal air will flow to the signal inlet port $S_1$ to cause the attitude of the pilot changeover valve 12 to be such that the main air pressure will be fed to the rear of the cylinder 2. Interconnected between the manifold block 11 and the normally closed valve 13 is a valve 16 which is normally open but which is automatically closed by means of a cam 17 when operation of the cutting blades 27 is overridden when several strokes of the block 23 are necessary to draw a required length of insulated conductor through the machine 21.

As will be seen in FIG. 3, the normally closed valve 13 is mounted adjacent the shaft 22 so that it will be actuated to open the valve by the block 23 when it has drawn the required length of insulated conductor through the measuring, cutting and stripping machine 21. The spring-biased changeover valve 14 is actuated by a cam 15 operatively connected to the square shaft 22 in a manner to be described.

Operation of the ejection device 7 is controlled by signal air pressure fed from the manifold block 11 through a normally closed valve 18 to the rear end of the cylinder 8 of the ejection device. Opening of the normally closed valve 18 to cause the piston 9 of the ejection device 7 to be urged forward is controlled by a cam 19 mounted on the main shaft 32 of the terminating machine 31.

As in the apparatus described with reference to FIGS. 1 and 2, the cycle of operations of the terminating machine is controlled by micro-switch 20 actuated by the head 5 of the reciprocating piston 3.

When the electrical lead processing apparatus is in operation, the claming jaws 24 on the block 23 grip the leading end of the insulated conductor C and start to draw it through the machine 21. As the block 23 passes the axis of the piston 3, it actuates the normally closed valve 13 to open the valve and so permit signal air pressure to be fed via the changeover valve 14 to the signal inlet port $S_1$ to cause the attitude of the pilot changeover valve 12 to be such that main air pressure is fed to the rear of the cylinder 2 to urge the piston 3 towards the machine 21 so that the fixed U-shaped bracket 74 pushes the insulated conductor under the spring-loaded finger 6 which holds the insulated conductor against the upper surface of the head 5. Meanwhile the block 23 continues drawing insulated conductor through the machine—the insulated conductor sliding under the spring-loaded finger 6—until the required length of insulated conductor extends between the block and the cutting and stripping station 25 and the cutters 27 are brought into operation as previously described.

Partial rotation of the shaft 22 now causes the cam 15 to change the attitude of the changeover valve 14 so that signal air pressure is transferred from signal inlet port $S_1$ to signal inlet port $S_2$. This changes the attitude of changeover valve 12 so that the main air pressure is transferred to the forward end of the cylinder 2 to cause the piston 3 to retract so that the head 5 and spring-biased finger 6 gripping the electrical lead are in the terminating position 33. As the head 5 approaches this position it actuates the micro-switch 20 to bring the terminating machine 31 into operation. At the same time, the block 23 starts to move towards the cutting and stripping station 25, in so doing allowing the valve 13 to close so that no signal air pressure can be fed to the cylinder 2 during the terminating operation.

The crimping and ejection operations are then automaticaly effected as described with reference to FIGS. 1 and 2.

In a modified form of the second preferred electrical lead transfer unit as shown in FIG. 5, the normally closed valve 13, actuated by the reciprocating block 23, and the spring-biased changeover valve 14, actuated by cam 15 carried by the square shaft 22, are replaced by a single spring-biased changeover valve 41 actuated by a rotating cam 42 that is belt driven from a pulley coupled to the shaft 22 of the measuring, cutting and stripping machine 21 via a 10–1 reduction gear train so that the cam completes one revolution per cycle of the machine. The attitude of the valve 41 is so biased that signal air pressure will be fed to the signal inlet port $S_1$ of the pilot changeover valve 12. After the cutting and stripping operations have been carried out in the machine 21, the cam 42 will have rotated to such an extent that it actuates the valve 41 to cause signal air pressure to be transferred from the signal inlet port $S_1$ to the signal inlet port $S_2$. As the block 23 again draws a length of insulated conductor through the machine 21, the cam 42 will have rotated a full cycle so that the valve 41 will have returned under spring pressure to the attitude in which signal air pressure will be fed to signal inlet port $S_1$. In all other respects, operation of the modified electrical lead transfer is the same as that of the preferred transfer unit.

We have found that the preferred forms of the electrical lead transfer unit can be used in the processing of as many as 3,000 terminated electrical leads per hour with substantially no supervision by an operator.

Figure 6:
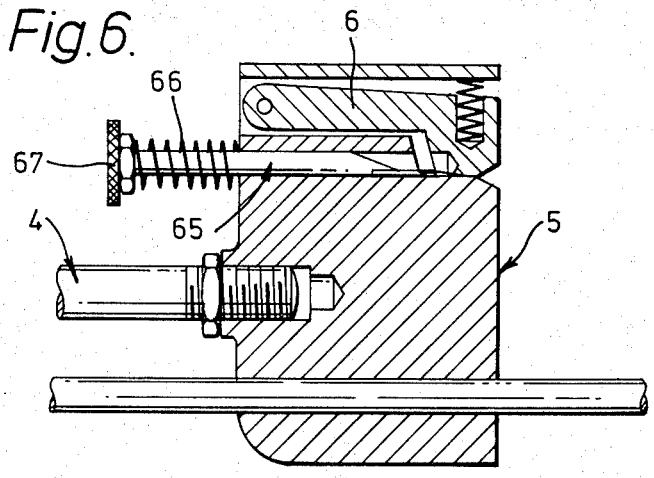
FIG. 6 is a side view of the preferred automatic ejection device of the electrical lead transfer units.

As will be seen on referring to FIG. 6, in the preferred ejection device used in the transfer unit shown in FIGS. 1 and 2 and FIGS. 3 and 4, the head 5 secured to the leading end of the rod 4 connected to the piston 3 has a spring loaded plunger 65 mounted on it, the plunger being biased by a spring 66 in the retracted position. The pusher 10 at the leading end of the spring-loaded pneumatically operated piston 9, when operated, is adapted to engage the protruding rear end 67 of the plunger 65 to urge it forward against the action of the spring 66 to push a terminated lead from beneath the spring-loaded finger 6. When the piston 9 returns to its retracted position, the plunger 65 also returns to its retracted position under the action of the spring 66.

What we claim as our invention is:

1. For use in transferring an electrical lead from a measuring, cutting and stripping machine having a cutting and stripping head and a clamping head movable axially of a wire to be cut into separate leads from said cutting and stripping head to a lead measuring position spaced from said cutting and stripping head to a terminating machine having a drive shaft, a transfer unit comprising (a) a fluid-operated piston working in a cylinder;

(b) an electrical lead gripping device which is carried by the piston and which is caused to be reciprocated by the said piston in a rectilinear direction substantially parallel to the direction of motion of the said piston and transverse to the length of an electrical lead being measured, cut and stripped in the measuring, cutting and stripping machine between a first position at which the gripping device grips an electrical lead being measured, cut and stripped in the measuring, cutting and stripping machine and a second position transversely spaced therefrom at which an electrical termination can be secured by the terminating machine to a stripped end of an electrical lead carried by the gripping device while another electrical lead is being measured, cut and stripped by the measuring, cutting and stripping machine;

(c) means for ejecting an electrical lead from the gripping device after an electrical termination has been secured to one of the ends of the electrical lead, which automatic ejection means comprises a spring-loaded pneumatically operated piston working in a cylinder, a source of air pressure, a normally closed valve by which said source of air pressure is connected to said piston, and a cam adapted to be rotatably driven by the drive shaft of the terminating machine, which cam controls the normally closed valve and is so shaped that after a termination has been secured to an electrical lead, it opens the valve to effect the operation of the piston against the action of its spring to push the terminated electrical lead out of the gripping device; and (d) a control system for effecting automatic reciprocation of the gripping device between said two positions and operation of the ejection means in synchronisation with the cycles of operations of the measuring, cutting and stripping machine and of the terminating machine whereby a lead is drawn through the cutting and stripping head while the lead gripping device is removed from its first position.

2. For use in transferring an electrical lead from a measuring, cutting and stripping machine having a cutting and stripping head and a clamping head movable axially of a wire to be cut into separate leads from said cutting and stripping head to a lead measuring position spaced from said cutting and stripping head to a terminating machine having a drive shaft, a transfer unit comprising (a) a fluid-operated piston working in a cylinder;

(b) an electrical lead gripping device which is carried by the piston and which is caused to be reciprocated by the said piston in a rectilinear direction substantially parallel to the direction of motion of said piston and transverse to the length of an electrical lead being measured, cut and stripped in the measuring, cutting and stripping machine between a first position at which the gripping device grips an electrical lead being measured, cut and stripped in the measuring, cutting and stripping machine and a second position transversely spaced therefrom at which an electrical termination can be secured by the terminating machine to a stripped end of the electrical lead carried by the gripping device while another electrical lead is being measured, cut and stripped by the measuring, cutting and stripping machine;

(c) means for ejecting an electrical lead from the gripping device after an electrical termination has been secured to one of the ends of the electrical lead, which automatic ejection means comprises a spring-loaded pneumatically operated piston working in a cylinder, a source of air pressure, a normally closed valve by which said source of air pressure is connected to said piston, and a cam adapted to be rotatably driven by the drive shaft of the terminating machine, which cam controls the normally closed valve and is so shaped that, after a termination has been secured to an electrical lead, it opens the valve to effect the operation of the piston against the action of its spring to push the terminated electrical lead out of the gripping device; and (d) a fluid-operated control system which is coupled directly to the cylinder of the fluid-operated piston carrying the gripping device and which includes means for detecting the cycle of operations of each of said machines, the control system being adapted to effect automatic reciprocation of the gripping device between said two positions and operation of the ejection means in synchronisation with the cycles of operations of the measuring, cutting and stripping machine and of the terminating machine, whereby a lead is drawn through the cutting and stripping head by the clamp head while the lead gripping device is removed from its first position.

3. An electrical lead transfer unit as claimed in claim 2, wherein the control system and the piston carrying the gripping device are pneumatically operated.

4. An electrical lead transfer unit as claimed in claim 3, wherein the control system includes a source of air pressure and an electrically actuated spring-biased changeover valve which has a single main inlet to which air pressure from said source is continuously supplied and a pair of outlets connected to the cylinder housing the piston carrying the gripping device on opposite sides of the piston and wherein the means for detecting the cycle of operations of the measuring, cutting and stripping machine controls the operation of the changeover valve, the attitude of the changeover valve being changed from its spring-biased position to the other of its two positions by the application of an electrical signal to a solenoid operating the valve.

5. An electrical lead transfer unit as claimed in claim 4; wherein the means for detecting the cycle of operations of the measuring, cutting and stripping machine is an electric control circuit in which are connected in series the solenoid of the electrically operated spring-biased changeover valve and a plurality of electrical switches actuated in sequence by the measuring, cutting and stripping machine during its cycle of operations.

6. An electrical lead transfer unit as claimed in claim 3, wherein the control system includes a source of air pressure and a pilot changeover valve which has a single main inlet to which air pressure from said source is continuously applied and a pair of outlets connected to the cylinder on opposite sides of the piston carrying the gripping device, means for detecting the cycle of operations of the measuring cutting and stripping machine controlling the operation of said pilot changeover valve, the attitude of the pilot changeover valve being determined by signal air pressure being applied to one of two opposed signal inlet ports under the control of said detecting means, whereby when an uninterrupted air supply is connected to the main inlet of the pilot changeover valve, the gripping device carried by the piston will be maintained either in the position at which the gripping device grips an electrical lead being measured, cut and stripped by the measuring, cutting and stripping machine or in the position at which an electrical termination can be secured by the terminating machine to a stripped end of an electrical lead carried by the gripping device, in accordance with the last signal air pressure that was fed into the pilot changeover valve.

7. An electrical lead transfer unit as claimed in claim 6, wherein the means for detecting the cycle of operations of the measuring, cutting and stripping machine is a signal air system comprising said source of air pressure, a normally closed valve to which signal air pressure from said source of air pressure is continuously applied and which is connected to the single inlet of a spring-biased changeover valve which has a pair of outlets connected to the signal inlet ports of the pilot changeover valve, the attitude of the spring-biased changeover valve being so biased that the connection is normally open between the spring-biased changeover valve and that signal inlet port of the pilot changeover valve to which signal air pressure must be applied to cause the attitude of the pilot changeover valve to be such that main air pressure will be fed to the rear end of the cylinder to cause the gripping device to move to the position at which it will grip an electrical lead in the measuring, cutting and stripping machine, said cycle detecting means acting on said changeover valve whereby when a predetermined length of electrically insulated conductor has been measured by the measuring, cutting and stripping machine, the normally closed valve is automatically opened and signal air pressure flows through the spring-biased changeover valve to the said signal inlet port of the pilot changeover valve to cause the attitude of the pilot changeover valve to be such that main air pressure is fed to the rear end of the cylinder to cause the gripping device to move to the measuring, cutting and stripping machine and grip the predetermined length of insulated conductor; when the predetermined length of insulated conductor has been cut to form an electrical lead and insulation has been stripped from its end, the attitude of the spring-biased changeover valve is automatically changed against the action of the spring so that signal air pressure is fed to the other one of the signal inlet ports of the pilot changeover valve to change the attitude of this valve and so cause the main air pressure to be fed to the front of the cylinder so that the piston carrying the gripping device is caused to move in the opposite direction to bring the gripping device carrying the electrical lead to the position at which an electrical termination can be secured to its stripped end by the terminating machine; and, as the cycle of operations of the measuring, cutting and stripping machine is concluded, the normally closed valve closes and the attitude of the spring-biased changeover valve returns to its biased position.

8. An electrical lead transfer unit as claimed in claim 6, wherein the means for detecting the cycle of operations of the measuring, cutting and stripping machine is a signal air system comprising a single spring-biased changeover valve having a single inlet connected to a continuous signal air pressure and a pair of outlets connected to the signal inlet ports of the pilot changeover valve, the attitude of the changeover valve being so biased that the connection is normally open between the spring-biased changeover valve and that signal inlet port of the pilot changeover valve to which signal air pressure must be applied to cause the attitude of the pilot changeover valve to be such that main air pressure will be fed to the rear end of the cylinder to cause the gripping device to move to the position at which it will grip an electrical lead in the measuring, cutting and stripping machine, actuation of the spring-biased changeover valve being controlled by a rotating cam so coupled to the drive shaft of the measuring, cutting and stripping machine that appropriate changeover of the valve to ensure reciprocation of the gripping device back and forth between said two positions is effected once per cycle of operations of the measuring, cutting and stripping machine.

9. An electrical lead transfer unit as claimed in claim 1 or 2, wherein operation of the terminating machine in synchronization with the cycle of operations of the measuring, cutting and stripping machine and the transfer of an electrical lead from the measuring, cutting and stripping machine to the position at which an electrical termination can be secured to a stripped end of the electrical lead is controlled by a micro-switch which is positioned in the path of the gripping device and is actuated by the gripping device to start the cycle of operations of the terminating machine as the gripping device reaches the position at which an electrical termination can be secured to an electrical lead.

10. An electrical lead transfer unit as claimed in claim 1 or 2, wherein the gripping device comprises a substantially rigid elongate member extending axially from the piston and a head which is mounted on one end of the elongate member and which carries a pivoted, spring-loaded finger urged towards a surface of the head in such a way that an electrical lead can be gripped between the spring-loaded finger and a surface of the head.

* * * * *

UNITED STATES PATENT AND TRADEMARK OFFICE

CERTIFICATE OF CORRECTION

PATENT NO. : 4,403,383

DATED : September 13, 1983

INVENTOR(S) : PAUL E. DEWHURST and JOHN C. COLLIER

It is certified that error appears in the above-identified patent and that said Letters Patent is hereby corrected as shown below:

Column 5, line 28, "FIG. 1" should read --FIG. 2--.

Column 8, line 22, "claming" should be --clamping--.

Claim 5, column 11, line 24, "4;" should be --4,--.

Signed and Sealed this

*Twenty-seventh* Day of *December 1983*

[SEAL]

*Attest:*

GERALD J. MOSSINGHOFF

*Attesting Officer*

*Commissioner of Patents and Trademarks*